US006202237B1

(12) United States Patent
Chang

(10) Patent No.: US 6,202,237 B1
(45) Date of Patent: Mar. 20, 2001

(54) BED HAVING MASSAGE DEVICE

(76) Inventor: Horng Jiun Chang, No. 26-23, Tien Chong Yian Lane, Yuan Lin Town, Chang Hua Hsien (TW)

( * ) Notice: Subject to any disclaimer, the term of this patent is extended or adjusted under 35 U.S.C. 154(b) by 0 days.

(21) Appl. No.: 09/323,389

(22) Filed: Jun. 1, 1999

(51) Int. Cl.[7] ..... A47C 27/10; A61H 23/04

(52) U.S. Cl. ..... 5/713; 5/933; 601/148

(58) Field of Search ..... 5/690, 654, 933, 5/706, 713, 710; 297/284.3, 284.6, 452.41; 601/55, 148, 149, 150, 151

(56) References Cited

U.S. PATENT DOCUMENTS

| | | | | |
|---|---|---|---|---|
| 3,008,465 | * | 11/1961 | Gal | 5/713 |
| 3,595,223 | * | 7/1971 | Castagna | 601/148 |
| 4,017,118 | * | 4/1977 | Cawley | 297/284.3 |
| 4,524,762 | * | 6/1985 | Schulman | 5/654 |
| 4,583,255 | * | 4/1986 | Mogaki et al. | 5/713 |
| 5,029,939 | * | 7/1991 | Smith et al. | 601/148 |
| 5,135,282 | * | 8/1992 | Pappers | 601/148 |
| 5,192,304 | * | 3/1993 | Rassman | 5/933 |
| 5,320,409 | * | 6/1994 | Katoh et al. | 297/284.6 |
| 5,611,772 | * | 3/1997 | Fujimoto et al. | 601/149 |
| 5,657,499 | * | 8/1997 | Vaughn et al. | 5/654 |
| 5,792,082 | * | 8/1998 | Yamanaka et al. | 601/55 |

FOREIGN PATENT DOCUMENTS

| | | | | |
|---|---|---|---|---|
| 405345005 | * | 12/1993 | (JP) | 601/148 |

* cited by examiner

*Primary Examiner*—Alexander Grosz
(74) *Attorney, Agent, or Firm*—Charles E. Baxley

(57) ABSTRACT

A bed includes a number of holes for receiving a number of pneumatic actuating devices, such as the air bag type or the bellows type pneumatic actuating devices. An air pump supplies a pressurized air to the pneumatic actuating devices via a number of air valves to actuate the pneumatic actuating devices to act on the users. An air reservoir is disposed between the air pump and the air valves for storing the pressurized air. One or more seats are disposed on the bed and each has a pneumatic actuating device for acting on the side portion of the user.

11 Claims, 3 Drawing Sheets

BED HAVING MASSAGE DEVICE

BACKGROUND OF THE INVENTION

1. Field of the Invention

The present invention relates to a bed, and more particularly to a bed having a massage device.

2. Description of the Prior Art

Typical beds comprise one or more rollers engaged therein and driven by a motor in order to strike onto or to act on the user's body. However, the user's body may be hurt by the rollers sometimes.

The present invention has arisen to mitigate and/or obviate the afore-described disadvantages of the conventional massage devices for beds.

SUMMARY OF THE INVENTION

The primary objective of the present invention is to provide a bed including a massage device that is actuated by pressurized air.

In accordance with one aspect of the invention, there is provided a bed comprising a plurality of holes formed therein, a plurality of pneumatic actuating devices disposed in the holes of the bed body, and means for supplying pressurized air to the pneumatic actuating devices and to actuate the pneumatic actuating devices to act on the user.

The pneumatic actuating devices each includes a bulge disposed thereon and extended outward of the bed body for acting on the user. The pressurized air supplying means includes a plurality of air valves coupled to the pneumatic actuating devices respectively, and an air pump coupled to the air valves for supplying the pressurized air to the pneumatic actuating devices via the air valves. An air reservoir is disposed between the air pump and the air valves for storing the pressurized air.

The pneumatic actuating devices are bellows type pneumatic actuating devices or are air bag type pneumatic actuating devices.

One or more seats are further disposed thereon and each having a pneumatic actuating device disposed therein and directed to a side portion of the user. The pneumatic actuating devices of the seats each includes a bulge disposed thereon and extended outward of the seats for acting on the side portion of the user. A plate is secured on the bed body for supporting the seats.

The bed body includes a belt threaded therein, the plate is detachably secured on the belt for allowing the belt to adjust the plate and the seats relative to the bed body. The bed body includes a pair of grooves formed therein for threading the belt, the belt is adjustable along the grooves for adjusting the seats relative to the bed body.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
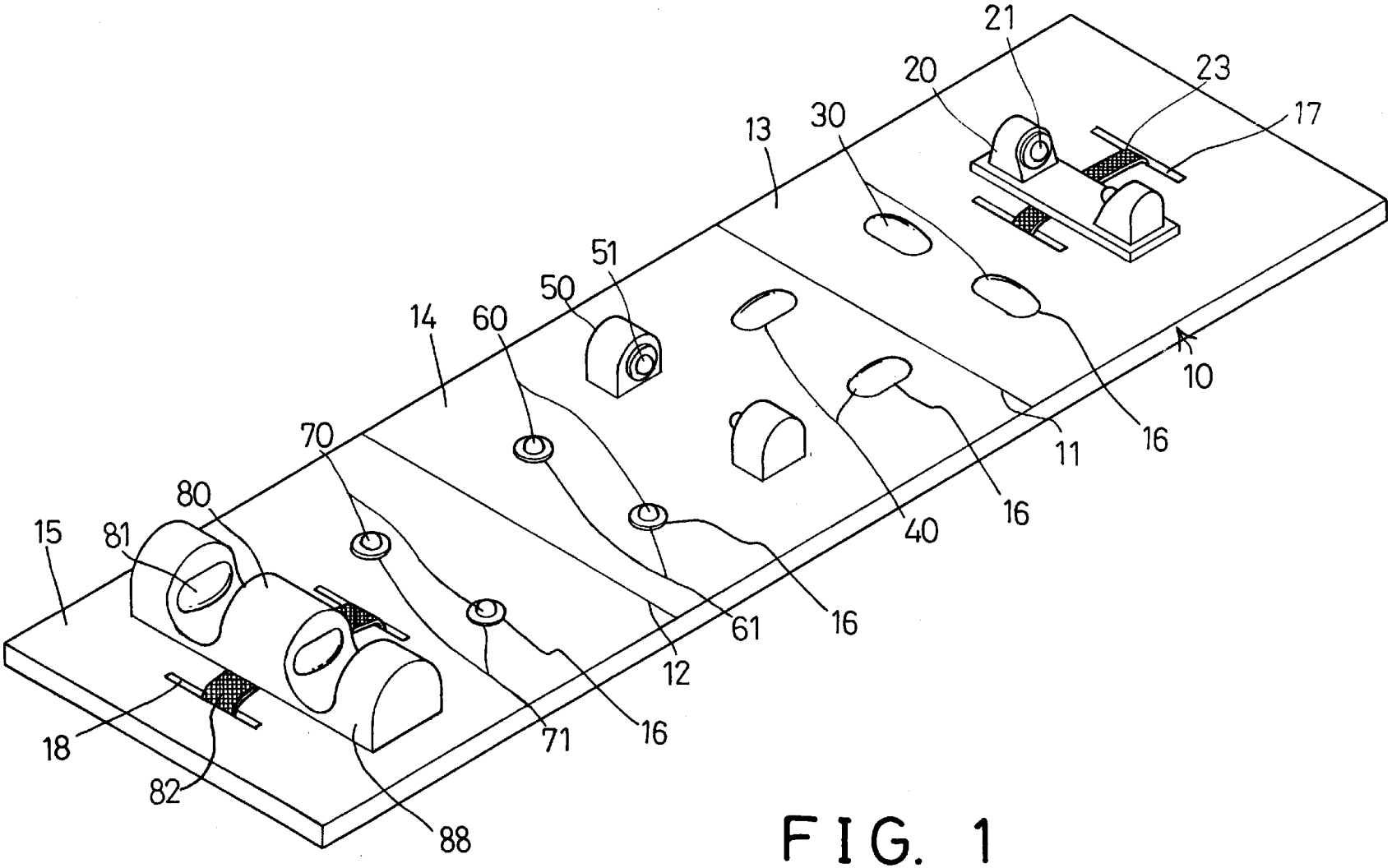
FIG. 1 is a perspective view of a bed in accordance with the present invention.
Figure 2:
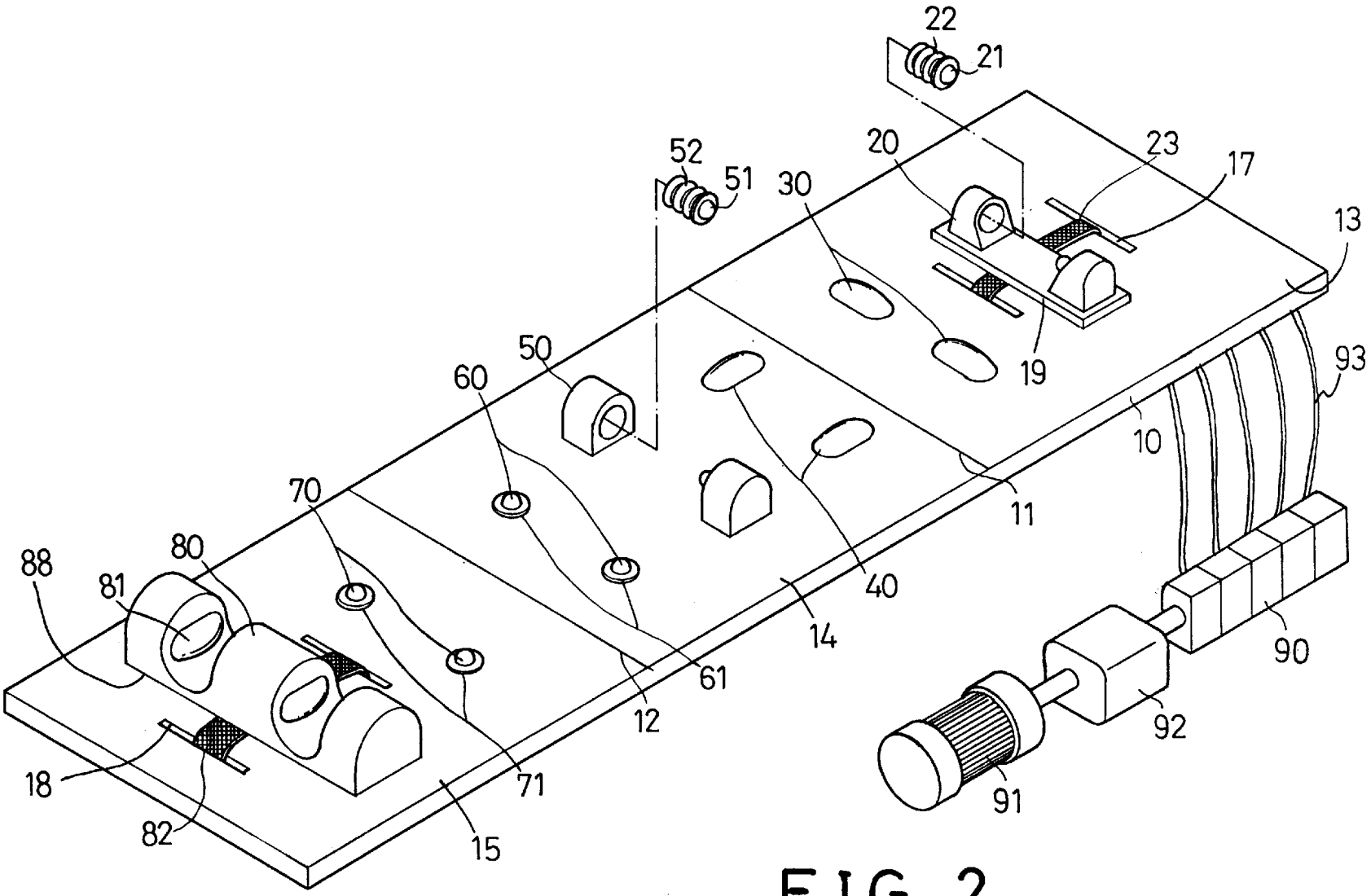
FIG. 2 is a partial exploded view of the massage device.
Figure 3:
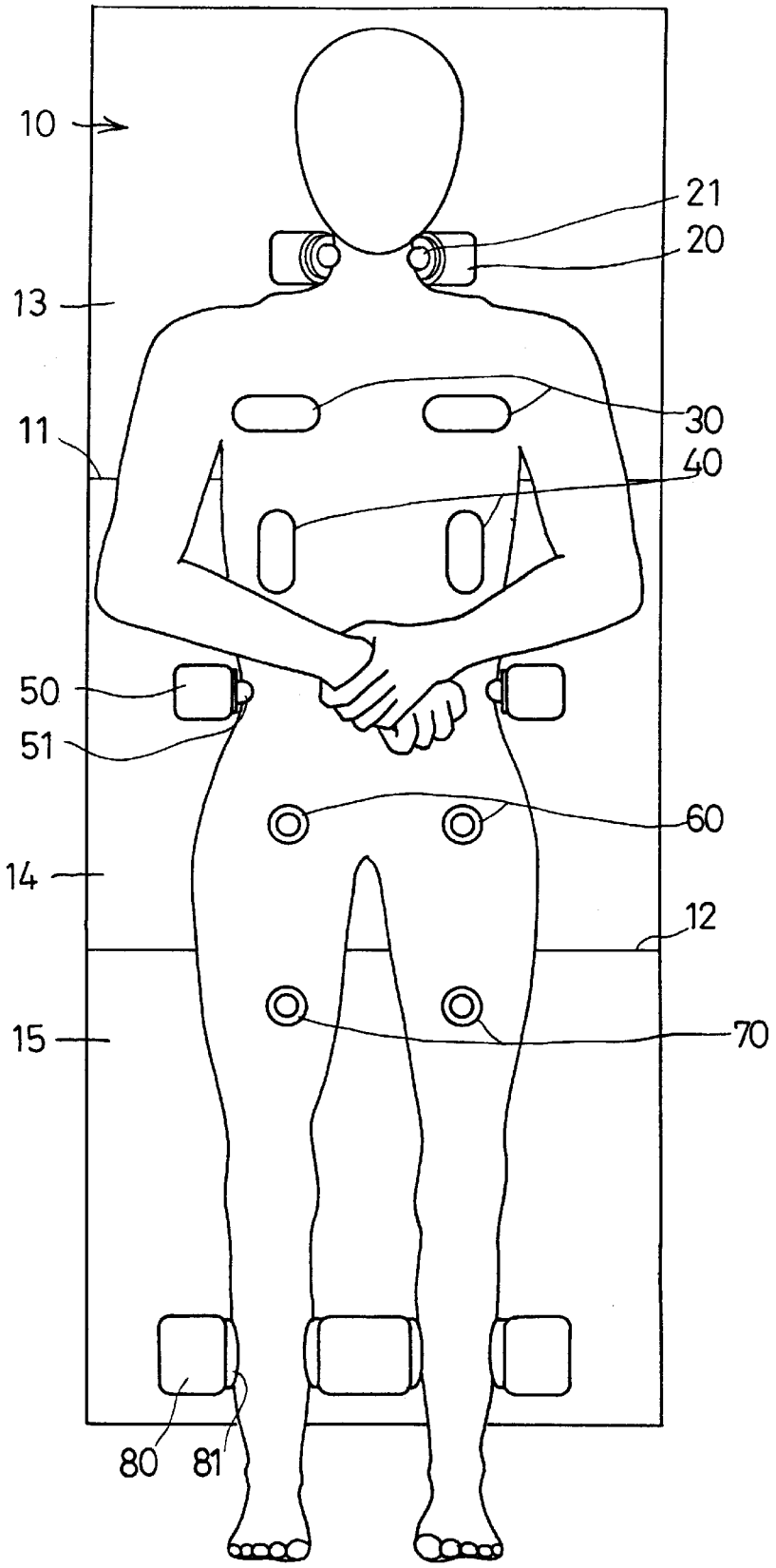
FIG. 3 is a top plane view illustrating the operation of the massage device of the bed.

Referring to the drawings, a bed in accordance with the present invention comprises a bed body 10 preferably made of spongy materials or foamable materials and including a number of holes 16 formed therein for receiving a number of air bag type pneumatic actuating devices 30, 40 and/or a number of bellows type pneumatic actuating devices 61, 71 respectively. The devices 61, 71 each includes a bulge 60, 70 provided thereon and extended outward of the bed body 10 for massaging the user's body (FIG. 3), such as the leg portions or the back portions of the user. The air bags 30, 40 also slightly extended outward of the bed body 10 for massaging the user's body, such as the leg portions or the back portions of the user. The bed body 10 further includes a pair of opposite seats 50 disposed on the middle portion and located corresponding to the sides of the waist portion of the user and each having a hole formed therein for receiving a bellows type pneumatic actuating device 52 therein respectively. The bellows type pneumatic actuating devices 52 each includes a bulge 51 provided thereon and extended outward of the seat 50 for massaging the user.

The bed body 10 includes one or more live hinges 11, 12 provided for separating the bed body 10 into two or more sections. For example, two live hinges 11, 12 are formed in the bed body 10 for separating the bed body 10 into three sections 13, 14, 15 and for supporting the upper portion and the middle portion and the leg portion of the user respectively. The bed body 10 may be folded to a compact structure at the live hinges 11,12.

The upper section 13 of the bed body 10 includes a pair of grooves 17 formed therein for threading a belt 23, particularly an endless belt 23. A plate 19 is detachably secured to the belt 23 with such as a hook and loop device or the like and includes two seats 20 provided thereon and located corresponding to the sides of the neck portion of the user and each having a hole formed therein for receiving a bellows type pneumatic actuating device 22 therein respectively. The bellows type pneumatic actuating devices 22 each includes a bulge 21 provided thereon and extended outward of the seat 20 for massaging the user. The belt 23 may be moved and adjusted along the grooves 17, and the plate 19 may be adjusted relative to the belt 23, or the belt 23 may be moved relative to the bed body 10 for moving the plate 19 between the grooves 17 of the bed body 10, such that the bellows type pneumatic actuating devices 22 may be used for massaging the neck portion of the user.

The lower section 15 of the bed body 10 includes a pair of slots 18 formed therein for threading a belt 82, particularly an endless belt 82. Three seats 80 are provided on a board 88 which is detachably secured to the belt 82 with such as a hook and loop device or the like. The seats 80 includes two pairs of air bag type pneumatic actuating device 81 provided therein and located corresponding to the sides of the leg portions of the user and extended outward of the seat 80 for massaging the user. The belt 82 may be moved and adjusted along the slots 18 of the bed body 10, and the board 88 may be adjusted relative to the belt 82, or the belt 82 may be moved relative to the bed body 10 for moving the board 88 between the slots 18 of the bed body 10, such that the air bag type pneumatic actuating devices 81 may be adjusted and used for massaging the suitable portions of the legs of the user.

An air pump 91 is coupled to an air reservoir 92 for producing and for supplying the pressurized air to the air reservoir 92 which is then coupled to a number of air valves 90. The air valves 90 are then coupled to the pneumatic actuating devices 21, 30, 40, 61, 71, 81 by hoses 93 for pumping the devices and for actuating the devices to massage the user's body. The devices 21, 52, 81 disposed in the seats 20, 50, 80 respectively may be used for massaging the neck portion and the waist portion and the leg portions of the user respectively.

It is to be noted that the bulges 21, 51, 60, 70 of the devices 20, 50, 61, 71 are used to simply depress against a number of points of the user's body. The engaging depth of the bulges 21, 51, 60, 70 into the human body may be predetermined and may be arranged for preventing the human body from being hurt. The air reservoir 92 may be used to store the pressurized air.

Accordingly, the massage device of the bed in accordance with the present invention may be actuated by pressurized air and will not hurt the user's body.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A bed comprising:

a bed body for supporting a user and including a plurality of holes formed therein, a plurality of pneumatic actuating devices disposed in said holes of said bed body, and means for supplying pressurized air to said pneumatic actuating devices and to actuate said pneumatic actuating devices to act on the user, wherein said bed body includes a pair of seats disposed thereon and each having a pneumatic actuating device disposed therein and directed to a side portion of the user.

2. The bed according to claim 1, wherein said pneumatic actuating devices each includes a bulge disposed thereon and extended outward of said bed body for acting on the user.

3. The bed according to claim 1, wherein said pressurized air supplying means includes a plurality of air valves coupled to said pneumatic actuating devices respectively, and an air pump coupled to said air valves for supplying the pressurized air to said pneumatic actuating devices via said air valves.

4. The bed according to claim 3 further comprising an air reservoir disposed between said air pump and said air valves for storing the pressurized air.

5. The bed according to claim 1, wherein said pneumatic actuating devices are bellows type pneumatic actuating devices.

6. The bed according to claim 1, wherein said pneumatic actuating devices are air bag type pneumatic actuating devices.

7. The bed according to claim 1, wherein said pneumatic actuating devices of said seats each includes a bulge disposed thereon and extended outward of said seats for acting on the side portion of the user.

8. The bed according to claim 1 further comprising means for adjusting said seats relative to said bed body.

9. The bed according to claim 1 further comprising a plate secured on said bed body, said seats being disposed on said plate.

10. The bed according to claim 9, wherein said bed body includes a belt threaded therein, said plate is detachably secured on said belt for allowing said belt to adjust said plate and said seats relative to said bed body.

11. The bed according to claim 10, wherein said bed body includes a pair of grooves formed therein for threading said belt, said belt is adjustable along said grooves for adjusting said seats relative to said bed body.

* * * * *